United States Patent [19]

Young

[11] 4,287,496

[45] Sep. 1, 1981

[54] ASSEMBLY FOR POSITIONING THE COUPLING PROBE OF A WAVEGUIDE

[75] Inventor: William C. Young, Moorestown, N.J.

[73] Assignee: RCA Corporation, New York, N.Y.

[21] Appl. No.: 152,307

[22] Filed: May 22, 1980

[51] Int. Cl.[3] ..... H01P 1/00; H01P 5/04

[52] U.S. Cl. ..... 333/248; 324/58 B

[58] Field of Search ..... 333/24 R, 232, 245, 333/248; 324/58 R, 58 A, 58 B, 58 C, 58.5 R, 58.5 A, 58.5 B, 58.5 C, 95, 158 P

[56] References Cited

U.S. PATENT DOCUMENTS

| | | | |
|---|---|---|---|
| 2,838,670 | 6/1958 | Marcuvitz | 324/58 C X |
| 4,035,749 | 7/1977 | Slocum et al. | 333/248 X |

*Primary Examiner*—Paul L. Gensler

*Attorney, Agent, or Firm*—Samuel Cohen; Robert L. Troike

[57] ABSTRACT

First and a second cylinder-like members, the first located in a wall of a waveguide and rotatable about its center axis, and the second within the first member and rotatable about its central axis which is offset from the central axis of the first member. A coupling probe extends through the second cylinder-like member near the periphery thereof.

8 Claims, 6 Drawing Figures

ASSEMBLY FOR POSITIONING THE COUPLING PROBE OF A WAVEGUIDE

This invention generally relates to an assembly for varying the position within a waveguide of a coupling probe. Electromagnetic energy, in the form of electromagnetic waves, can be transmitted to or received from a waveguide by employing a coupling probe which is an extension of the center conductor of a coaxial cable. The present invention relates to an improved means for positioning a coupling probe, such as a coaxial line probe, within the waveguide so that, for example, the maximum amount of electromagnetic energy is transferred.

In a system embodying the invention, a first cylinder-like member is rotatably positioned in an aperture in one of the walls of the waveguide. Means rotatably positioned in the first member and adapted to receive the coaxial coupling probe therethrough is provided for positioning the coupling probe within the waveguide.

In the drawing, which is not drawn to scale:

Figure 1:
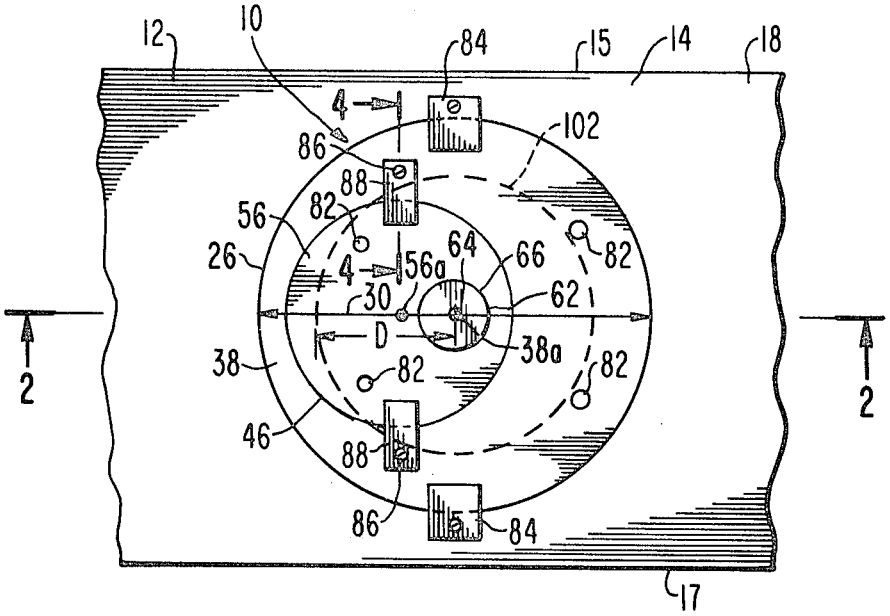
FIG. 1 is a plan view of an assembly for varying the position of a coaxial coupling probe in a waveguide according to one embodiment of this invention.
Figure 2:
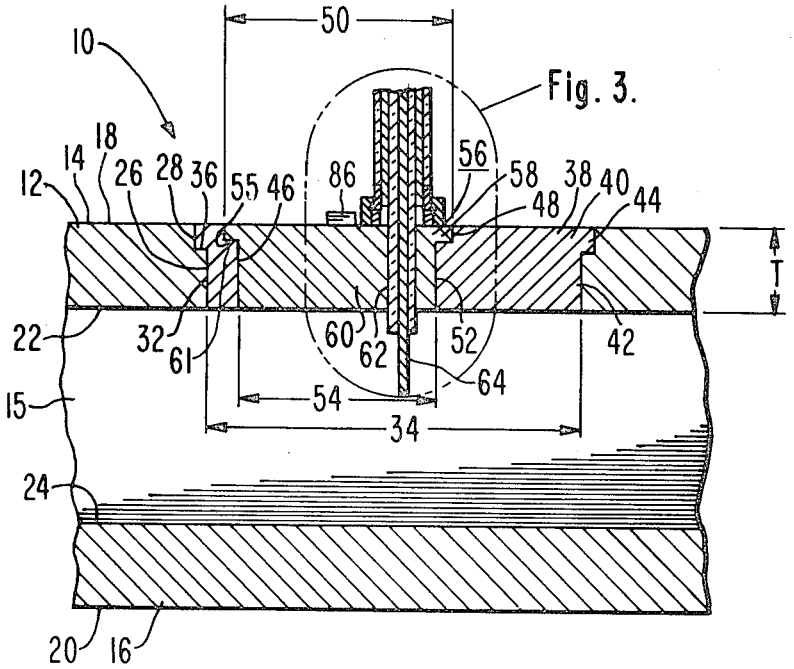
FIG. 2 is a sectional view of the assembly shown in FIG. 1 taken along the line 2—2 thereof.

Referring to FIGS. 1 and 2, assembly 10 includes a length of rectangular waveguide 12 having a pair of electrically conductive opposing broad walls, 14 and 16, spaced apart by a pair of electrically conductive opposing side walls 15 and 17. Each of the broad walls 14 and 16 of thickness T, has an exterior surface, 18 and 20, respectively, and an interior surface, 22 and 24 respectively. One of the broad walls, for example 14, has an aperture 26 extending therethrough. For reasons which are discussed below, the aperture 26 is preferably circular and has a first portion 28 having a comparatively larger diameter 30 adjacent the exterior surface 18 and a second portion 32 having a comparatively smaller diameter 34 adjacent the interior surface 22. Preferably, the first portion 28 of the aperture 26 and the second portion 32 thereof are coaxial. The transition between these two portions is abrupt so as to create a first shoulder 36 in the plane of the transition.

A first electrically conductive circular cylinder-like member 38 having, in one particular embodiment, a thickness equal to the thickness "T" of the broad wall 14, is rotatably positioned in the aperture 26 of the broad wall 14. The first cylinder-like member 38 has a first portion 40 which has a diameter slightly less than that of the first portion 28 of the aperture 26 and a second portion 42, coaxial with the first portion 40, having a diameter slightly less than that of the second portion 32 of the aperture 26. The diameter of the member 38 is made just slightly less than the diameter aperture 26 to allow the member to freely rotate. The transition between the first portion 40 of the cylinder-like member 38 and the second portion 42 is abrupt so as to create a first flange-like surface 44 which rests upon the first shoulder 36. The thickness of the first and second portions, 40 and 42 respectively of the first cylinder-like member 38 are preferably about equal to the respective thicknesses of the first and second portions, 28 and 32 respectively, of the aperture so that the total thickness of 38 is equal to about T. Thus, when the cylinder-like member 38 is positioned in the aperture 26 of the broad wall 14 it is substantially flush, i.e. coplanar with the exterior and interior surfaces, 18 and 22 respectively, thereof.

The first cylinder-like member 38 has an aperture 46 extending therethrough. The aperture 46 is preferably circular and has an upper portion 48 having a comparatively larger diameter 50 and a lower portion 52, coaxial with the upper portion 48, having a comparatively smaller diameter 54. The transition between the larger diameter upper portion 48 and the smaller diameter lower portion 52 is abrupt so as to form a second shoulder 55 in the plane of the transition. Preferably, for the most advantageous use of the assembly 10, the aperture 46 is eccentric with respect to the axis of the first circular cylinder-like member 38. The amount of eccentricity is more fully discussed below.

A second electrically conductive circular cylinder-like member 56 having, in one particular embodiment, a thickness equal to the thickness "T" of the first cylinder-like member 38, is rotatably positioned in the aperture 46 of the first cylinder-like member 38. Similar to the first cylinder-like member 38, the second cylinder-like member 56 has an upper portion 58 which has a diameter slightly less than that of the upper portion 48 of the aperture 46 and a lower portion 60, coaxial with the first portion 58, having a diameter slightly less than that of the lower portion 52 to allow member 56 to freely rotate. The transition between the upper and lower portions, 58 and 60 respectively, of the second cylinder-like member 56 is abrupt so as to create a second flange-like surface 61 which rests upon the second shoulder 55. The thickness of the upper and lower portions, 58 and 60, respectively, of the second cylinder-like member 56 are preferably about equal to the respective thickness of the upper and lower portions, 48 and 52 respectively, of the aperture 46. Thus, when the second cylinder-like member 56 is positioned in the aperture 46 of the first cylinder-like member 38 it is substantially flush, i.e. coplanar therewith.

The second cylinder-like member 56 has an aperture 62 therethrough adapted to receive a coaxial coupling probe 64. The aperture 62 is preferably, to maximally utilize the assembly 10, eccentric with respect to the axis of the second cylinder-like member 56. The amount of eccentricity is more fully discussed below.

Figure 3:
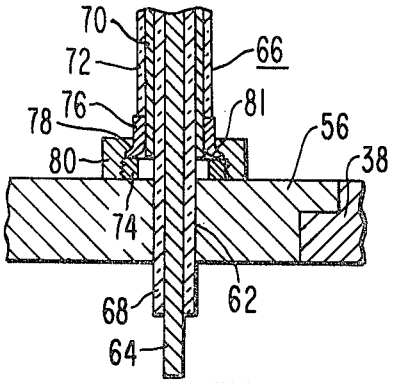
FIG. 3 is a sectional detail view of the coaxial coupling probe.

The coaxial coupling probe 64 and the attachment mechanism associated therewith are not shown in detail or cross-hatched in FIGS. 1 and 2. FIG. 3 shows, in detail, an exemplary adaptive configuration. As shown therein, the coaxial probe 64 can be the center conductor of a coaxial cable 66. Ordinarily, a coaxial cable 66 includes a center conductor or probe 64 surrounded by a first sheath 68 of electrically insulating material. The first sheath 68 is surrounded by (coaxial with) a layer 70 of electrically conductive material, known as a ground conductor. The layer 70 is surrounded by a second sheath 72 of electrically insulating material.

As shown, the aperture 62 has a diameter designed to snugly receive the first sheath 68 of electrically insulating material which extends a short distance into the waveguide 12. The extension of the first sheath 68 into the waveguide 12 ensures that most of the electromagnetic energy is propagated along the center of the waveguide 12. The center conductor extends into the waveguide 12 to about half the distance between the broad walls, 14 and 16 to form a coupling probe 64. The second cylinder-like member 56 is provided with an electrically conductive exteriorly threaded circular ridge 74 which is concentric with the aperture 62.

A portion of the sheath 72 is removed to permit an electrically conductive cylindrical member 76 electrically to contact the ground conductor 70 of the cable 66. The cylindrical member 76 has an inside diameter designed to snugly surround the ground conductor 70 and is affixed to the ground conductor 70 by crimping or by other known techniques. The cylindrical member 74 extends beyond the ground conductor 70 and terminates in a flare 78.

The interior threads of element 80 mate with the exterior threads of ridge 74 for urging via rim 81 of element 80 the flare 78 of the cylindrical member 76 against the ridge 74.

Referring back to FIG. 1, the first and second cylinder-like members 38 and 56 respectively, are provided with means 82 for which can be engaged for rotating these members. For example, the means 82 can be dimples designed to receive the prongs of a spanner wrench (not shown) for rotating the members, 38 and 56, not only with respect to the broad wall 14 but also with respect to each other.

First retaining means 84 are provided about the periphery of the first cylinder-like member 38 for restricting the rotational movement thereof with respect to the broad wall 14. Second retaining means 86 are provided about the periphery of the second cylinder-like member 56 for restricting the rotational movement thereof.

Figure 4:
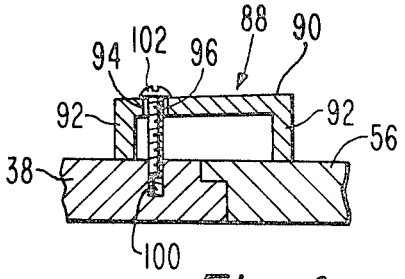
FIG. 4 is a sectional view of a clamping arrangement shown in FIG. 1 taken along the line 4—4 thereof.

While the retaining means, 84 and 86, can be any conventional clamping mechanism known in the art, one particular type is shown in FIG. 4. In the example shown, the clamp 86 comprises an inverted, generally U-shaped, member 88 having a back portion 90 and a pair of legs 92 which contact the assembly 10. The back portion 90 is provided with an opening 94 through which a screw 96 extends. The screw 96 is threaded into a threaded opening 100 in the first cylinder-like member 38. The length of the legs 92, the length of the screw 96 and the depth of the opening 94 are selected so that the screw 96 can be tightened and, via a washer (not shown) or its head 102, apply sufficient pressure, via the legs 92, to immobilize the second cylinder-like member 56 with respect to the first cylinder-like member 38. Preferably, the retaining means 84, and 86 are made of an electrically conductive metal to provide good grounding connections.

In one particular embodiment, wherein the center frequency of the electromagnetic wave energy to be propagated in the waveguide 12 is about 3 GHz, the broad walls, 14 and 16, have a width of about 7.6 cm. For exemplary purposes the thickness of both the broad walls, 14 and 16, and the side walls is taken as about 0.2 cm. The first cylinder-like member 38 has a first diameter 30 of about 4.4 cm and a second diameter 34 of about 4.1 cm. The second cylinder-like member 56 has a first diameter 50 of about 2.8 cm and a second diameter 54 of about 2.5 cm. The aperture 62 has a diameter of about 0.7 cm to receive the coaxial coupling probe 64 and the surrounding first sheath 68 of insulating material. In this embodiment, the eccentricity, i.e. the distance between the center of the aperture 62 with respect to the axis of the second cylinder-like member 56, is about 0.56 cm.

The area within which the coaxial coupling probe 64 can be positioned is of paramount importance and is discussed using the dimensions of the above example. The coaxial coupling probe 64 must be capable of being rotatably positioned to the center, or center axis 38*a* of the first cylinder-like member 38 in order to permit the positioning of the probe 64 to cover an entire preselected area and so there will not exist an area, interior to the preselected area, in which the probe 64 cannot be positioned. For this example, then, the coaxial coupling probe 64 is positionable at the center axis 38*a* of the first cylinder-like member 38 as depicted in FIG. 1.

When the first cylinder-like member 38 is immobilized with respect to the broad wall 14 and the second cylinder-like member 56 is rotated through 360° the coaxial coupling probe 64 describes a circle having a diameter D equal to twice the distance of the offset of center of the aperture 62 with respect to the center 56*a* of the second cylinder-like member 56. In this embodiment that circle has a diameter of about 1.12 cm, i.e. $2\times0.56$ cm. To determine the total area within which the coaxial coupling probe 64 can be positioned, the second cylinder-like member 56 is positioned such that the coupling probe 64 is at the furthest point with respect to the axis of the first cylinder-like member 38. The second cylinder-like member 56 is then immobilized with respect to the first cylinder-like member 38 which is then rotated 360°. The dashed line circle 102 in FIG. 1 illustrates the path of the probe 64 when the first cylinder-like member 38 is rotated and the second cylinder-like member 56 is positioned so that the probe 64 is at its maximum distance from the center of the first cylinder-like member. The diameter of the circle 102 is about 2.24 cm ($2\times D$). By rotation of the first and second members, the coaxial coupling probe 64 can be positioned at any point within the dashed line 102.

Figure 5:
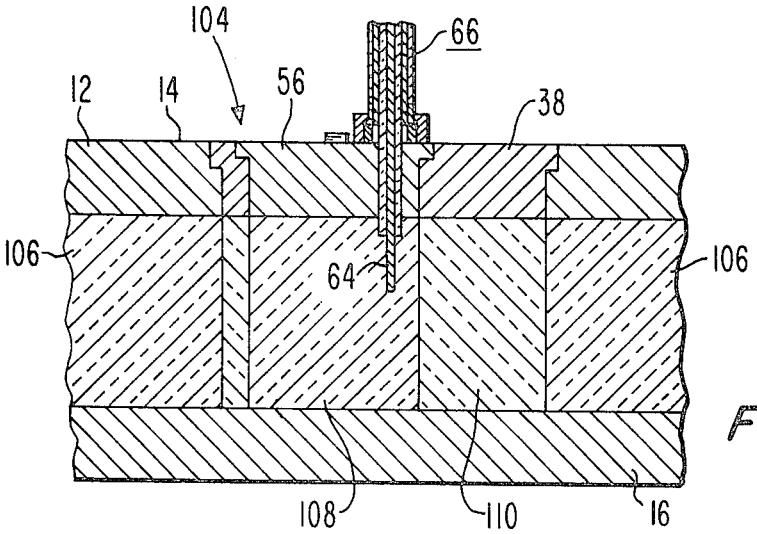
FIG. 5 is a sectional view of an assembly for varying the position of a coaxial coupling probe in a dielectrically loaded waveguide according to another embodiment of this invention.

While the above-described assembly 10 is quite useful for any rectangular waveguide 12, it is particularly useful in conjunction with a dielectrically filled waveguide. As assembly 104 including a dielectrically filled waveguide is shown, in section, in FIG. 5. For simplicity, features of the assembly 104 which correspond to features of the above-described assembly 10, are designated by the same numerals.

As shown, the assembly 104 includes a waveguide 12 which is filled with dielectric material 106 having such properties as desired. Examples of dielectrics used in the art are beryllia and alumina. For reasons which will become apparent, the dielectric material 106 is machined, using techniques well known in the art, so that the portion of the waveguide 12 subtending the first and second cylinder-like members 38 and 56 respectively, is void of the dielectric material 106.

A first cylinder 110 of dielectric material, which is preferably composed of the same material as the dielectric material 106, is bonded to the first cylinder-like member 38 and extends across the waveguide 12 between the broad walls 14 and 16. A second cylinder 108 of dielectric material, which is preferably composed of the same material as the dielectric material 106 is bonded to the second cylinder-like member 56. The second cylinder 108 is adapted to accept, in close tolerance, therein the coaxial coupling probe 64 and the first sheathing 68. Further, it is preferred that the second cylinder 108 extend completely between the broad walls 14 and 16. The first cylinder 110 is adapted to receive and thus surround the second cylinder 108 of dielectric material.

The first and second cylinders, 110 and 108 respectively, are machined, using known techniques, so that the second cylinder 108 is free to rotate within the first cylinder 110 and first cylinder-like member 110 is free to rotate within the dielectric material 106. While the first and second cylinders, 108 and 110 respectively, must be free to rotate, the distances therebetween, as well as the distance between the second cylinder 110 of dielectric material and the dielectric material 106 which fills the waveguide 12 should be minimized to reduce perturbation of electromagnetic waves traveling between the coupling probe 64 and the dielectric material 106.

Figure 6:
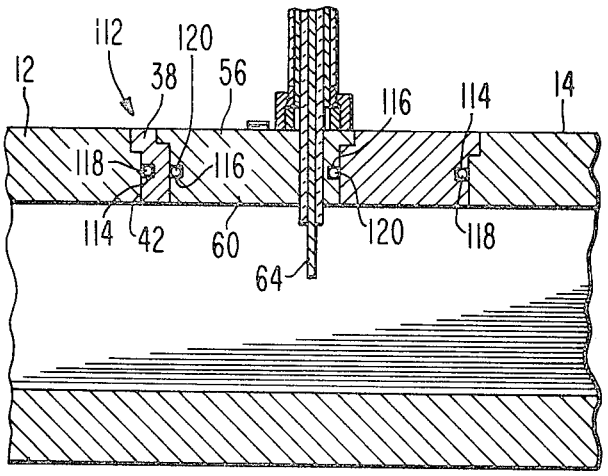
FIG. 6 is a sectional view of an assembly for varying the position of a coaxial coupling probe in a gas filled waveguide according to yet another embodiment of this invention.

The assembly 10 in FIG. 1 is also adaptable for use in an embodiment which requires the waveguide 12 to be under positive gaseous pressure. Such a gaseous pressurization is often employed when the magnitude of the electromagnetic energy propagated in the waveguide 12 can cause arcing, i.e. the dielectric breakdown of the air in the waveguide 12. To reduce this possibility of arcing, it is advantageous to pressurize the waveguide 12 with a dielectric gas. FIG. 6 illustrates one particular assembly 112, employing one such adaptation. In FIG. 6, like features are designated by the same reference numerals as used for describing the assembly 10 in FIG. 1.

In order to seal the interfaces of the assembly 112 to maintain a positive gas pressure within the waveguide 12, the second portion 42 of the first circular cylinder-like member 38 and the lower portion 60 of the second circular cylinder-like member 56 are provided with first and second grooves, 114 and 116 respectively about the periphery thereof. The first and second grooves 114 and 116 respectively, are sized to accept first and second 0-rings, 118 and 120 respectively. The first 0-ring 118 seals the interface between the first cylinder-like member 38 and the broad wall 14 of the waveguide 12 and the second 0-ring seals the interface between the second cylinder-like member 56 and the first cylinder-like member 38. Thus, by the incorporation of the 0-rings, 118 and 120, the waveguide 12 is capable of maintaining a positive gaseous pressure.

In operation, the assembly 10, 104 or 112, is located in the waveguide 12 such that the coupling probe 64 is located a distance of about a quarter wavelength of center frequency from a shorted end thereof. The other end of the waveguide 12 is connected to a dissipative load located several wavelengths away from the assembly 10, 104 or 112. The load is so located to ensure that higher order modes decay before reaching the load. Thus, only the reflection of the fundamental mode impinges upon the coaxial coupling probe 64. The power level of the reflected wave is then measured, using apparatus such as a reflectometer or other known measuring means. As well known, a reflectometer is an instrument capable of measuring power reflection parameters while simultaneously providing an RF power output.

Thus, for probe position tests, the coaxial cable 66 is connected to a reflectometer which provides RF power to the coaxial coupling probe 64. The ground conductor 70 of the coaxial cable 66 is, in fact, electrically grounded via the electrically conductive material of the components of the assembly 10, 104, or 112 and the electrically conductive walls of the waveguide 12. The reflectometer, usually by use of an internal directional coupler network, measures the reflected power picked up by the coaxial coupling probe 64. The position of the coupling probe 64 is then adjusted and the measurements repeated. The coaxial coupling probe 64 is moved to different positions until the reflected power measured is at a minimum. As well known, when the reflected power is at a minimum the transmitted power is at a maximum. It will be understood that the energy reflected from the shorted end of the waveguide 12 has a negligible effect on the power measured at the coupling probe 64. This is becuase the shorted end of the waveguide 12 is about a quarter wavelength away at the operating frequency from the coupling probe 64 and power reflected therefrom is about 180° out of phase with the power emanating from the coupling probe 64 and is thus effectively canceled out at the coupling probe 64.

What is claimed is:

1. An assembly for positioning a coupling probe within a waveguide having a pair of opposing walls, one of the walls being formed with a circular aperture therein, said assembly comprising:

a first circular cylinder-like member rotatably positioned in said aperture in said wall about a first axis comprising the central axis of said first member; and means adapted to receive said coupling probe therethrough in a position offset from the central axis of said means, and rotatably positioned in said first cylinder-like member about a second axis displaced from the first axis, for positioning said coupling probe within said waveguide, said second axis comprising said central axis of said means.

2. An assembly as claimed in claim 1 wherein said means is a second circular cylinder-like member having a coupling probe aperture therethrough adapted to receive said coupling probe therethrough, said second cylinder-like member being rotatably positioned about said second axis offset with respect to said first axis and being within an aperture located in said first cylinder-like member.

3. An assembly as claimed in claim 2 wherein said aperture in said wall includes a first portion having a comparatively larger diameter and a second portion having a comparatively smaller diameter whereby a first shoulder is formed in the plane of transition between said first portion and said second portion of said first aperture;

said first cylinder-like member has a first portion having a comparatively larger diameter and a second portion having a comparatively smaller diameter whereby a first flange-like surface is formed in the plane of transition between said first portion and said second portion of said first cylinder-like member; and said first cylinder-like member is positioned in said aperture in said wall such that said first flange-like surface rests upon said first shoulder.

4. An assembly as claimed in claim 3 wherein the first cylinder-like member aperture includes an upper portion having a comparatively larger diameter and a lower portion having a comparatively smaller diameter whereby a second shoulder is created in the plane of transition between said upper portion and said lower portion of said first cylinder-like member aperture;

said second cylinder-like member has an upper portion having a comparatively larger diameter and a lower portion having a comparatively smaller diameter whereby a second flange-like surface is created in the plane of transition between said upper portion and said lower portion of said second cylinder-like member; and said second cylinder-like member is positioned in said first cylinder-like member aperture such that said second flange-like surface rests upon said second shoulder.

5. An assembly as claimed in claim 4 further comprising:

a first groove in the periphery of said second portion of said first cylinder-like member adapted to receive a first 0-ring which provides a gas seal between said first cylinder-like member and said one wall of said waveguide; and a second groove in the periphery of said lower portion of said second cylinder-like member adapted to receive a second 0-ring which provides a gas seal between said second cylinder-like member and said first cylinder-like member.

6. An assembly as claimed in claim 2 wherein a first cylinder of dielectric material is fixed to said first cylinder-like member, said first cylinder of dielectric material extends across said waveguide;

a second cylinder of dielectric material is fixed to said second cylinder-like member; said second cylinder of dielectric material extends across said waveguide and is adapted to receive said coupling probe therein; said first cylinder is adapted to surround said second cylinder of dielectric material; and said waveguide being otherwise filled with a solid dielectric material.

7. An assembly as claimed in claim 6 wherein said first and second dielectric cylinders and said solid dielectric material in said waveguide all have substantially identical electrical characteristics.

8. An assembly as claimed in claim 2 wherein said coupling probe aperture is eccentric with respect to the center axis of said second cylinder-like member and cooperatively located in conjunction with said second cylinder-like member so that said coupling probe extending through said second aperture can be positioned at the center of said first cylinder-like member.

* * * * *